US007833954B2

(12) United States Patent
Hutchison

(10) Patent No.: US 7,833,954 B2
(45) Date of Patent: Nov. 16, 2010

(54) LUBRICATING COMPOSITION

(75) Inventor: David A. Hutchison, Powhatan, VA (US)

(73) Assignee: Afton Chemical Corporation, Richmond, VA (US)

( * ) Notice: Subject to any disclaimer, the term of this patent is extended or adjusted under 35 U.S.C. 154(b) by 222 days.

(21) Appl. No.: 12/029,344

(22) Filed: Feb. 11, 2008

(65) Prior Publication Data

US 2009/0203560 A1 Aug. 13, 2009

(51) Int. Cl.
*C10L 1/22* (2006.01)
*C10M 173/02* (2006.01)

(52) U.S. Cl. ..... 508/232; 508/239; 508/528

(58) Field of Classification Search ..... 508/528, 508/232, 239

See application file for complete search history.

(56) References Cited

U.S. PATENT DOCUMENTS

| | | | | |
|---|---|---|---|---|
| 3,338,832 | A | 8/1967 | Le Suer | |
| 4,152,499 | A | 5/1979 | Boerzel et al. | |
| 4,428,850 | A | 1/1984 | Zoleski et al. | |
| 4,943,672 | A | 7/1990 | Hamner et al. | |
| 4,948,523 | A * | 8/1990 | Hutchison et al. | 508/273 |
| 5,174,915 | A | 12/1992 | Hutchison et al. | |
| 5,496,480 | A | 3/1996 | Rollin et al. | |
| 5,882,505 | A | 3/1999 | Wittenbrink et al. | |
| 6,013,171 | A | 1/2000 | Cook et al. | |
| 6,080,301 | A | 6/2000 | Berlowitz et al. | |
| 6,096,940 | A | 8/2000 | Wittenbrink et al. | |
| 6,103,099 | A | 8/2000 | Wittenbrink et al. | |
| 6,165,949 | A | 12/2000 | Berlowitz et al. | |
| 6,180,575 | B1 | 1/2001 | Nipe | |
| 6,444,622 | B1 * | 9/2002 | Balasubramaniam | 508/187 |
| 2003/0096716 | A1 * | 5/2003 | Locke et al. | 508/525 |

FOREIGN PATENT DOCUMENTS

| | | |
|---|---|---|
| EP | 0310365 | 4/1989 |
| GB | 1111680 | 5/1968 |

OTHER PUBLICATIONS

Hutchison, "Lubricating Composition", U.S. Appl. No. 11/842,729, filed Aug. 21, 2007.
Hutchison et al., "Lubricating Composition", U.S. Appl. No. 11/609,084, filed Dec. 11, 2006.
Loper et al., "Lubricating Composition", U.S. Appl. No. 11/567,557, filed Dec. 6, 2006.
Loper, "Lubricating Composition", U.S. Appl. No. 11/567,585, filed Dec. 6, 2006.
European Search Report, European Patent Office, European Patent Application No. 09150577.6-2104, May 26, 2009, 3 Pages.
Kazuyoshi, Ryuichi, Masatami: Bulletin of the Chemical Society of Japan, vol. 37, No. 6, 1964, pp. 874-876, XP007908555.

* cited by examiner

*Primary Examiner*—Walter D Griffin
*Assistant Examiner*—Frank C Campanell

(57) ABSTRACT

The present application is directed to a lubricant composition comprising a major amount of a base oil; and a lead corrosion inhibiting amount of a reaction product of a hydrocarbyl carbonyl compound and an amine compound chosen from guanidines, ureas and thioureas; with the proviso that the lubricant is essentially free of zinc dialkyldithiophosphate wear inhibitors, and substantially free of chlorinated paraffins and calcium mannich phenate.

24 Claims, No Drawings

LUBRICATING COMPOSITION

DESCRIPTION OF THE DISCLOSURE

1. Field of the Disclosure

The present disclosure is directed to additive and lubricant compositions and methods for use thereof. More particularly, this invention is directed to an additive composition comprising the reaction product of a hydrocarbyl carbonyl compound and an amine compound chosen from guanidines, ureas and thioureas.

2. Background of the Disclosure

Lead and lead alloys are known for use in many types of engines and other machines. For example, lead alloys are known for use in bearings used in many applications, including main bearings used in spark ignition and compression-ignition internal combustion engines, also referred to as diesel engines.

Lubricants employed in lead containing engines have been observed to cause undesirable lead corrosion. For example, lubricants for medium speed diesel engines are used in applications where thousands of horsepower (e.g., 2000 to 10,000 horsepower) are needed and often run at a speed of about 100 to 1,200 rpm. This demanding environment results in oxidation of the oil, which can in turn result in corrosion of the metals, such as lead, present in the engine. Lead corrosion can also be a problem in other lubricant applications, including passenger car engine oils, high speed diesel engine oils, turbine oils, automatic transmission fluids and many industrial lubricants.

While lead corrosion inhibitors are known for reducing lead corrosion caused by these lubricant formulations, lead corrosion can still be problematic. Accordingly, novel lead corrosion inhibitors are desirable in the art for providing improved lead corrosion protection.

Some engines, such as medium speed diesel engines, also have silver parts, such as silver bearings. Thus, apart from providing stability against oxidation and protection against the formation of sludge and carbonaceous deposits, lubricating compositions intended for use in medium speed diesel engines are often formulated with specialized silver protecting agents in order that silver bearings in the engine are not attacked either by the additives in the oil or by the decomposition products produced during extended engine operation. Such agents, often referred to as silver lubricity agents, protect against extreme pressure, wear and corrosion. Examples of such silver protecting agents are disclosed in U.S. Pat. No. 4,948,523, issued to David Hutchison et al., the disclosure of which is incorporated herein by reference in its entirety.

A typical engine lubricating composition might comprise, for example, detergents, dispersants, antioxidants, foam inhibitors, rust inhibitors, extreme pressure agents and antiwear agents. The most commonly used extreme pressure and antiwear agents are sulfur-containing agents, such as zinc dialkyldithiophosphates (ZDDP). However, it is well known that some sulfur-containing agents cannot be used in engines having silver parts given their known propensity to damage the silver bearings. This recognized tendency is explained, for example, in U.S. Pat. No. 4,428,850. Thus, it is desirable to find lubricant compositions that can provide oxidation protection and in some cases can be essentially free of these potentially damaging sulfur-containing extreme pressure or antiwear agents, such as ZDDP, while at the same time providing protection against corrosion of metals, such as lead.

SUMMARY OF THE DISCLOSURE

In accordance with the disclosure, one aspect of the present application is directed to a lubricant composition comprising a major amount of a base oil; and a lead corrosion inhibiting amount of a reaction product of a hydrocarbyl carbonyl compound and an amine compound chosen from guanidines, ureas and thioureas; with the proviso that the lubricant is essentially free of zinc dialkyldithiophosphate wear inhibitors, and substantially free of chlorinated paraffins and calcium mannich phenate.

A method of improving lead corrosion protection of a machine, the method comprising: contacting a lead part in a machine with a lubricant composition comprising a minor amount of a reaction product of a hydrocarbyl carbonyl compound and an amine compound chosen from guanidines, ureas and thioureas; wherein the lubricant composition provides improved lead corrosion protection as compared to the same composition that does not contain the reaction product, where both compositions are employed under the same machine operating conditions over the same period of time.

Additional embodiments and advantages of the disclosure will be set forth in part in the description which follows, and/or can be learned by practice of the disclosure. It is to be understood that both the foregoing general description and the following detailed description are exemplary and explanatory only and are not restrictive of the disclosure, as claimed.

DESCRIPTION OF THE EMBODIMENTS

The present disclosure generally relates to a lubricant composition comprising a major amount of a base oil and a minor amount of an additive compound formed by reacting (i) a hydrocarbyl carbonyl compound and (ii) an amine compound chosen from guanidines, ureas and thioureas. The compositions of the present application can offer one or more of the following benefits to lubricant compositions, including: decreased lead corrosion, decreased copper corrosion, good oxidation control, good anti-wear properties, good dispersancy and good seal polymer compatability.

As used herein, the term "major amount" is understood to mean an amount greater than or equal to 50 wt. %, for example from about 80 to about 98 wt. % relative to the total weight of the composition. Moreover, as used herein, the term "minor amount" is understood to mean an amount less than 50 wt. % relative to the total weight of the composition.

Hydrocarbyl Carbonyl Compound

The hydrocarbyl carbonyl reactant compound of the present application can be any suitable compound having a hydrocarbyl moiety and a carbonyl moiety, and that is capable of bonding with the amine compound to form the additive compounds of the present application. Non-limiting examples of suitable hydrocarbyl carbonyl compounds include, but are not limited to, hydrocarbyl substituted succinic anhydrides, hydrocarbyl substituted succinic acids, and esters of hydrocarbyl substituted succinic acids.

As used herein, the term "hydrocarbyl group" or "hydrocarbyl" is used in its ordinary sense, which is well-known to those skilled in the art. Specifically, it refers to a group having a carbon atom directly attached to the remainder of a molecule and having a predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

In some aspects, the hydrocarbyl carbonyl compound can be a polyalkylene succinic anhydride reactant having the following Formula IV:

IV

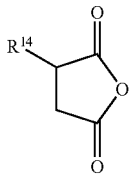

wherein $R^{14}$ is a hydrocarbyl moiety, such as for example, a polyolefin radical having a number average molecular weight of from about 100 to about 10,000 daltons. For example, the number average molecular weight of $R^{14}$ can range from about 1000 to about 5000 daltons, such as about 1200 to about 3000, as measured by GPC. Unless indicated otherwise, molecular weights in the present specification are number average molecular weights.

In some aspects, $R^{14}$ can be a polyolefin radical comprising one or more polymer units chosen from linear or branched alkenyl units. In some aspects, the alkenyl units can have from about 2 to about 10 carbon atoms. For example, the polyolefin radical can comprise one or more linear or branched polymer units chosen from ethylene radicals, propylene radicals, butylene radicals, pentene radicals, hexene radicals, octene radicals and decene radicals. In some aspects, $R^{14}$ can be a polyolefin radical in the form of, for example, a homopolymer, copolymer or terpolymer. In an aspect of the present disclosure, the $R^{14}$ group can be a polyisobutylene radical. The polyolefin compounds used to form the $R^{14}$ polyolefin radicals can be formed by any suitable methods, such as by conventional catalytic oligomerization of alkenes.

In an additional aspect, the hydrocarbyl moiety $R^{14}$ can be derived from a linear alpha olefin or an acid-isomerized alpha olefin made by the oligomerization of ethylene by methods well known in the art. These hydrocarbyl moieties can range from about 8 carbon atoms to over 40 carbon atoms. For example, alkenyl moieties of this type can be derived from a linear $C_{18}$ or a mixture of $C_{20-24}$ alpha olefins or from acid-isomerized $C_{16}$ alpha olefins.

In some aspects, high reactivity polyisobutenes having relatively high proportions of polymer molecules with a terminal vinylidene group can be used to form the $R^{14}$ group. In one example, at least about 60%, such as about 70% to about 90%, of the polyisobutenes comprise terminal olefinic double bonds. There is a general trend in the industry to convert to high reactivity polyisobutenes, and well known high reactivity polyisobutenes are disclosed, for example, in U.S. Pat. No. 4,152,499, the disclosure of which is herein incorporated by reference in its entirety.

Specific examples of hydrocarbyl carbonyl compounds include such compounds as dodecenylsuccinic anhydrides, $C_{16-18}$ alkenyl succinic anhydride, and polyisobutenyl succinic anhydride (PIBSA). In some embodiments, the PIBSA may have a polyisobutylene portion with a vinylidene content ranging from about 4% to greater than about 90%. In some embodiments, the ratio of the number of carbonyl groups to the number of hydrocarbyl moieties in the hydrocarbyl carbonyl compound can range from about 1:1 to about 6:1.

The hydrocarbyl carbonyl compounds can be made using any suitable method. Methods for forming hydrocarbyl carbonyl compounds are well known in the art. One example of a known method for forming a hydrocarbyl carbonyl compound comprises blending a polyolefin and maleic anhydride. The polyolefin and maleic anhydride reactants are heated to temperatures of, for example, about 150° C. to about 250° C., optionally, with the use of a catalyst, such as chlorine or peroxide.

Amine Compound

Suitable amine compounds can be chosen from guanidines, ureas and thioureas with a $C_5$ to $C_{60}$ aliphatic carboxylic acid. For example, the amine can be a compound of the general formulae III, or salts thereof:

III

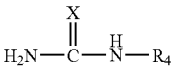

where X is $NR^5$, O or S, wherein $R^5$ is H or $C_1$ to $C_{15}$ hydrocarbyl; and $R^4$ is H, —$NR^7R^8$ or $C_1$ to $C_{20}$ hydrocarbyl or hydroxyl-substituted hydrocarbyl, wherein $R^7$ and $R^8$ can be the same or different and are H or $C_1$ to $C_{20}$ hydrocarbyl or hydroxyl-substituted hydrocarbyl.

In an embodiment of the present application, the amine can be chosen from the inorganic salts of guanidines, such as the halide, carbonate, nitrate, phosphate, and orthophosphate salts of guanidines. The term "guanidines" refers to guanidine and guanidine derivatives, such as aminoguanidine. In one embodiment, the guanidine compounds for the preparation of the additive compound is aminoguanidine bicarbonate. Guanidines, ureas, and thioureas used in the present application, including aminoguanidine bicarbonate, are readily obtainable from commercial sources, or can be prepared in a well-known manner.

The hydrocarbyl carbonyl and amine compounds described above can be mixed together under suitable conditions to provide the desired product compounds of the present disclosure. In one aspect of the present disclosure, the reactant compounds can be mixed together in a mole ratio of hydrocarbyl carbonyl to amine ranging from about 1:1.5 to about 1:2.5. For example, the mole ratio can range from about 1:1.8 to about 1:2.2, such as about 1:2.

Suitable reaction temperatures can range from about 155° C. to about 200° C. at atmospheric pressure. For example, reaction temperatures can range from about 160° C. to about 190° C. Any suitable reaction pressures can be employed, such as, including subatmospheric pressures or superatmospheric pressures. However, the range of temperatures can be different from those listed where the reaction is carried out at other than atmospheric pressure. The reaction can be carried out for a period of time within the range of about 1 hour to about 8 hours, preferably, within the range of about 2 hours to about 6 hours.

It is believed that the resulting reaction product is an aminotriazole. For example, the reaction product can be a bistriazole. The five-membered ring of the triazoles is considered to be aromatic. The aminotriazoles are fairly stable to oxidizing agents and are extremely resistant to hydrolysis.

In one exemplary embodiment, the hydrocarbyl carbonyl is a polyisobutenyl succinic anhydride and the amine is aminoguanidine bicarbonate. These compounds can be reacted together at a ratio of about 1 mole of polyisobutenyl succinic anhydride to 2 moles aminoguanidine bicarbonate at a temperature of about 160° C. It is believed, although it is not certain, that the reaction product is polybutenyl bis-3-amino-1,2,4-triazole. Such a product contains a relatively high nitrogen content, within the range of about 1.8 wt % to about 2.9 wt % nitrogen.

The compounds of the present application can allow formulation of lubricant compositions having relatively low total base number ("TBN"). In an aspect of the disclosure, the compositions can have a TBN of about 10 or less, such as about 5 to about 9. In other aspects, the TBN can be greater than 10, such as a TBN ranging from about 10 to about 20 or greater. "Total base number" is the measure of the alkaline reserve in the product in terms of its stoichiometric equivalent of mg KOH per gram of product.

The low total base number in combination with low sulfur (e.g., about 500 ppmw or less of sulfur) or ultra-low sulfur (e.g. about 15 ppmw or less) produces less sulfuric acid, and thus less alkalinity is needed to neutralize the acid. The use of the 1,2,4 triazoles of the present application allows good lead and copper protection, good antiwear and dispersance with minimal use of sulfur in the lubricant composition, because most alkalinity agents/detergents contain sulfur.

The compounds of the present application can reduce the need for metal and sulfur containing detergents in the formulation, and therefore can allow for low sulfur and/or low ash lubricant compositions. Most detergents and alkalinity agents now in use contain metals and/or sulfur, which produce and contribute to total "ash" content of the oil. For example, the total concentration of sulfur in the composition (including any free active sulfur, as discussed below) can range from about 4000 ppmw sulfur or less, such as about 200 ppmw sulfur. Low ash compositions can have a sulfated ash content of, for example, about 1% or less, based on the total weight of the composition, such as about 0 to 1000 ppmw sulfated ash.

The lubricant compositions disclosed herein, including the additive compositions that are discussed in more detail below, can optionally contain additives, such as dispersants, ash-containing detergents, ashless-detergents, pour point depressing agents, viscosity index improving agents, friction modifying agents, extreme pressure agents, rust inhibitors, supplemental antioxidants, supplemental corrosion inhibitors, anti-foam agents, and combinations thereof. In some aspects of the present disclosure, the multifunctionality of the lead inhibiting compounds of the present application can reduce the need for some of these optional additives. For example, the compounds of the present disclosure can potentially act as friction modifiers and copper corrosion inhibitors, thereby eliminating the need for employing additional friction modifiers and/or copper corrosion inhibitors to the formulation.

In some aspects, such as where the lubricant compositions do not contain ZDDP antiwear agents, the optional additives can include supplemental corrosion inhibitors. Non-limiting examples of such corrosion inhibitors include a second triazole compound that is different from the triazole compounds of the present application. One example of a suitable second triazole compound is the oleyl-1,2,4-triazole-3-amines discussed in U.S. Pat. No. 4,948,523, the disclosure of which is incorporated herein by reference, as described above. Yet other examples of suitable triazoles include those disclosed in copending U.S. applications Ser. Nos. 11/609,084; 11/567,557; and 11/567,585, the disclosures of all of which are hereby incorporated by reference in their entirety. Such supplemental corrosion inhibitors may be useful, for example, in machines containing silver parts and in medium speed diesel engines (whether or not they contain silver parts). In other embodiments, the composition does not include these supplemental corrosion inhibitors.

In an embodiment, the lubricant compositions of the present application can be essentially free, such as devoid, of compounds containing free active sulfur. As used herein, the phrase "active sulfur" is defined as sulfur containing compounds which would substantially react with machine parts to form metal sulfides at normal engine running temperatures ranging from about 100° C. to below about 400° C. Active sulfur is distinguished from non-active sulfur, which does not substantially react at temperatures under 400° C., but which may sufficiently react to form metal sulfides at temperatures above 400° C. so as to protect engine parts under extreme pressure conditions, or where boundary conditions exist. One of ordinary skill in the art would readily understand that temperatures significantly above 400° can occur at various positions in engines that typically operate at lower temperatures, such as below 400° C., due to these boundary regions and extreme pressure regions. Such boundary regions and extreme pressure regions can occur, for example, when a particular engine part, such as a bearing, is placed under load. Non-active sulfur compounds can be employed that will react to protect engine parts as these higher temperatures, while not substantially reacting at the generally lower engine operating temperatures. Accordingly, one of ordinary skill in the art understands that compounds containing active sulfur, such as zinc dialkyldithiophosphate (ZDDP), can exert a measurable deleterious effect upon some machines, such as medium speed diesel engines or machines that contain silver parts, while non-active sulfur compounds can still be employed to protect engine parts in these machines. For at least this reason, it may be desirable to omit active sulfur compounds from formulations intended for use in such machines. One skilled in the art would know how to determine the effect of sulfur containing compounds on machine parts, such as, for example, by measuring the amount of silver dissolved in the lubricant and/or the amount of deposits on the silver parts. The term "essentially free" is defined for purposes of this application to be concentrations having substantially no measurable deleterious effect.

In some embodiments, the lubricant compositions of the present application are substantially free, such as devoid, of compounds containing phosphorus. In other embodiments, the compositions of the present application can be substantially free, such as devoid of compounds containing boron. It can be desirable to omit phosphorus and/or boron containing compounds from formulations of the present application so that these elements can be used as markers to indicate lubricant contamination. For example, railroad engine oils are generally formulated to be free of phosphorus and boron. While in use, the oils are periodically checked for phosphorus and/or boron, the presence of which can indicate that the oil has been contaminated with e.g., ZDDP or, in the case of boron, boron containing coolants, during engine operation. In this manner, the phosphorus and/or boron act as markers to indicate contamination of the lubricant. By the phrase substantially free is meant that the composition comprises only trace amounts of phosphorus and/or boron, so that concentrations of these elements will have substantially no effect, for example, on the ability of phosphorus and boron to be used as markers.

Base oils suitable for use in formulating the disclosed compositions can be selected from any of the synthetic or mineral oils or mixtures thereof. Mineral oils include animal oils and vegetable oils (e.g., castor oil, lard oil) as well as other mineral lubricating oils such as liquid petroleum oils and solvent treated or acid-treated mineral lubricating oils of the paraffinic, naphthenic or mixed paraffinic-naphthenic types. Oils derived from coal or shale are also suitable. Further, oils derived from a gas-to-liquid process are also suitable.

The base oil can be present in a major amount, wherein "major amount" is defined as described above.

The base oil can have any desired viscosity that is suitable for the intended purpose. Examples of suitable engine oil kinematic viscosities can range from about 2 to about 150 cSt and, as a further example, from about 5 to about 15 cSt at 100° C. Thus, for example, base oils can be rated to have viscosity ranges of about SAE 15 to about SAE 250, and as a further example, from about SAE 20W to about SAE 50. Suitable automotive oils also include multi-grade oils such as 15W-40, 20W-50, 75W-140, 80W-90, 85W-140, 85W-90, and the like.

Non-limiting examples of synthetic oils include hydrocarbon oils such as polymerized and interpolymerized olefins (e.g., polybutylenes, polypropylenes, propylene isobutylene copolymers, etc.); polyalphaolefins such as poly(1-hexenes), poly-(1-octenes), poly(1-decenes), etc. and mixtures thereof; alkylbenzenes (e.g., dodecylbenzenes, tetradecylbenzenes, di-nonylbenzenes, di-(2-ethylhexyl)benzenes, etc.); polyphenyls (e.g., biphenyls, terphenyl, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic oils that can be used. Such oils are exemplified by the oils prepared through polymerization of ethylene oxide or propylene oxide, the alkyl and aryl ethers of these polyoxyalkylene polymers (e.g., methyl-polyisopropylene glycol ether having an average molecular weight of about 1000, diphenyl ether of polyethylene glycol having a molecular weight of about 500-1000, diethyl ether of polypropylene glycol having a molecular weight of about 1000-1500, etc.) or mono- and polycarboxylic esters thereof, for example., the acetic acid esters, mixed $C_{3-8}$ fatty acid esters, or the $C_{13}$ Oxo acid diester of tetraethylene glycol.

Another class of synthetic oils that can be used includes the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_{5-12}$ monocarboxylic acids and polyols and polyol ethers such as neopentyl glycol, trimethylol propane, pentaerythritol, dipentaerythritol, tripentaerythritol, etc.

Hence, the base oil used which can be used to make the compositions as described herein can be selected from any of the base oils in Groups I-V as specified in the American Petroleum Institute (API) Base Oil Interchangeability Guidelines. Such base oil groups are as follows:

Group I contain less than 90% saturates and/or greater than 0.03% sulfur and have a viscosity index greater than or equal to 80 and less than 120; Group II contain greater than or equal to 90% saturates and less than or equal to 0.03% sulfur and have a viscosity index greater than or equal to 80 and less than 120; Group III contain greater than or equal to 90% saturates and less than or equal to 0.03% sulfur and have a viscosity index greater than or equal to 120; Group IV are polyalphaolefins (PAO); and Group V include all other basestocks not included in Group I, II, III or IV.

The test methods used in defining the above groups are ASTM D2007 for saturates; ASTM D2270 for viscosity index; and one of ASTM D2622, 4294, 4927 and 3120 for sulfur.

Group IV basestocks, i.e. polyalphaolefins (PAO) include hydrogenated oligomers of an alpha-olefin, the most important methods of oligomerisation being free radical processes, Ziegler catalysis, and cationic, Friedel-Crafts catalysis.

The polyalphaolefins typically have viscosities in the range of 2 to 100 cSt at 100° C., for example 4 to 8 cSt at 100° C. They can, for example, be oligomers of branched or straight chain alpha-olefins having from about 2 to about 30 carbon atoms, non-limiting examples include polypropenes, polyisobutenes, poly-1-butenes, poly-1-hexenes, poly-1-octenes and poly-1-decene. Included are homopolymers, interpolymers and mixtures.

Regarding the balance of the basestock referred to above, a "Group I basestock" also includes a Group I basestock with which basestock(s) from one or more other groups can be admixed, provided that the resulting admixture has characteristics falling within those specified above for Group I basestocks.

Exemplary basestocks include Group I basestocks and mixtures of Group II basestocks with Group I bright stock.

Basestocks suitable for use herein can be made using a variety of different processes including but not limited to distillation, solvent refining, hydrogen processing, oligomerisation, esterification, and re-refining.

The base oil can be an oil derived from Fischer-Tropsch synthesized hydrocarbons. Fischer-Tropsch synthesized hydrocarbons can be made from synthesis gas containing $H_2$ and CO using a Fischer-Tropsch catalyst. Such hydrocarbons typically require further processing in order to be useful as the base oil. For example, the hydrocarbons can be hydroisomerized using processes disclosed in U.S. Pat. Nos. 6,103,099 or 6,180,575; hydrocracked and hydroisomerized using processes disclosed in U.S. Pat. Nos. 4,943,672 or 6,096,940; dewaxed using processes disclosed in U.S. Pat. No. 5,882,505; or hydroisomerized and dewaxed using processes disclosed in U.S. Pat. Nos. 6,013,171; 6,080,301; or 6,165,949.

Unrefined, refined and rerefined oils, either mineral or synthetic (as well as mixtures of two or more of any of these) of the type disclosed hereinabove can be used in the base oils.

Unrefined oils are those obtained directly from a mineral or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives, contaminants, and oil breakdown products.

In some embodiments, the additive compounds of the present application can be added to a lubricant composition in the form of a lubricant additive package composition. These are concentrates dissolved in a diluent, such as mineral oil, synthetic hydrocarbon oils, and mixtures thereof. When added to the base oil, the additive package composition can provide an effective concentration of the additives in the base oil. Thus, the concentrations of additive compound in the additive package can be chosen to be any suitable amount that will provide the desired effective concentration in the base oil. For example, the amount of the additive compounds of the present application in the additive package can vary from, for example, about 0.1 wt % to about 15 wt % or greater, of the additive package, such as from about 0.5 wt % to about 12 wt %, relative to the total weight of the additive package composition.

The additive compositions can be formulated to include any of the optional additives discussed in the present application. In embodiments where the additive composition is formulated for medium speed diesel engines, the optional additives discussed herein for medium speed diesel engines can also be employed.

While additional additive agents may be incorporated in the lubricating compositions of the present application, some aspects of the lubricant composition of the present application can exclude zinc containing wear agents if the lubricating compositions are used in diesel engines containing silver parts. This exclusion is intended to exclude amounts of zinc-containing wear inhibitors such as the zinc dihydrocarbyl dithiophosphate compounds sufficient to exert a measurable deleterious effect upon silver parts. At lesser amounts having no measurable deleterious effect, the lubricant is considered "essentially free" of zinc compounds for purposes of the present invention. If used in other engine environments which do not contain silver parts, the additives of the present invention can provide useful lubricity, wear, and anti-corrosion properties and may be used in conjunction with zinc compounds.

In some aspects, the compositions of the present disclosure can be free or substantially free of chlorine containing compounds, such as chlorinated paraffins, which are often used as silver lubricity agents. Examples of such chlorine containing compounds, which include Chlorowax, are described in U.S. Pat. No. 5,174,915, the disclosure of which is hereby incorporated by reference in its entirety. As used herein, "substantially free" means that the composition comprises only trace amounts of the compounds, so that the compounds have substantially no effect on the composition.

In aspects of the present application, the compositions of the present application can also be free or substantially free of organo-sulfur compounds. Examples of organo-sulfur compounds that can be excluded include sulfurized olefins, sulfurized fatty acids and esters, sulfur-containing heterocyclic compounds, sulfurized hydroxyaromatic compounds, disulfides, dithiocarbamates and thiadiazoles. In an embodiment, 1,3,4-thiadiazoles are excluded, such as 2,5-dimercapto-1,3,4 thiadiazole, the 2-mercapto-5-alkyldithio-1,3,4-thiadiazole, the 2,5-bis(alkyidithio)-1,3,4thiadiazole, and the 2-mercapto-5-alkylthio-1,3,4-thiadiazole, and 2,5-bis (hydrocarbyldithio)-1,3,4-thiadiazole where the hydrocarbyl substituent of the thiadazole is C1 to C30 alkyl. In other embodiments, 2-mercapto benzothiazole available from Vanderbilt under the trade name ROKON.RTM., dibenzyl disulfide, 4,4,-methylene bid(dibutyidithio) carbamate available from Vanderbilt under the trade name Vanlube.RTM. 7723, can also be excluded.

In yet other aspects of the present application, the compositions can be free or substantially free of 1,2,4 triazoles other than the triazoles of the present application. For example, the compositions can be substantially free of triazoles of formula II,

II

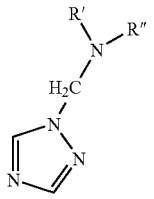

where R' and R" are independently chosen from hydrogen and hydrocarbyl groups, with the proviso that at least one of R' and R" is not hydrogen. Examples of suitable hydrocarbyl groups include $C_2$ to $C_{50}$ linear, branched or cyclic alkyl groups; $C_2$ to $C_{50}$ linear, branched or cyclic alkenyl groups; and substituted or unsubstituted aryl groups, such as phenyl groups, tolyl groups and xylyl groups. Other examples of triazoles that can be excluded are disclosed in copending application Ser. No. 11/842,729, filed on Aug. 21, 2007 in the name of David Hutchison and entitled LUBRICATING COMPOSITION, the description of which is incorporated by reference herein in its entirety.

In yet other embodiments, the compositions of the present application do not consist essentially of a mannich dispersant, a calcium mannich phenate, a calcium sulfonate, a calcium sulfurized phenate, mineral oil, a silver lubricity agent, and a polybutenyl bis-3-amino-1,2,4-triazole.

In yet other aspects, the compositions of the present application are free or substantially free of Mannich dispersants and/or alkaline earth metal Mannich phenates, such as calcium Mannich phenate.

According to various aspects of the present application, there is a method of improving lead corrosion protection in a lubricant composition. As used herein, the term "improving lead corrosion protection" is understood to mean enhancing the lead corrosion protection that a composition can provide to a machine, as compared to the same composition that is devoid of the compounds of the present application, where both compositions are employed under the same machine operating conditions over the same period of time. The method of improving lead corrosion protection can comprise providing to a machine a lubricant composition comprising a major amount of a base oil; and a minor amount of the reaction product of a hydrocarbyl carbonyl compound and amine compound, as disclosed above. In one embodiment, the machine is a diesel engine, such as a medium speed diesel engine.

The machine in the disclosed methods can be selected from the group consisting of spark ignition and compression-ignition internal combustion engines, including diesel engines, marine engines, rotary engines, turbine engines, locomotive engines, propulsion engines, aviation piston engines, stationary power generation engines, continuous power generation engines, engines comprising silver parts, and engines comprising lead parts. Moreover, the at least one moving part can comprise a gear, piston, bearing, rod, spring, camshaft, crankshaft, and the like.

The lubricant composition can be any composition that would be effective in lubricating a machine. In an aspect, the composition is selected from the group consisting of medium speed diesel engine oils, high speed diesel engine oils, turbine oils, automatic transmission fluids, industrial lubricants, passenger car motor oils and heavy duty diesel engine oils. In an embodiment, the composition is a medium speed diesel engine oil.

EXAMPLES

The following examples are illustrative of the invention and its advantageous properties. In these examples as well as elsewhere in this application, all parts and percentages are by weight unless otherwise indicated. It is intended that these examples are being presented for the purpose of illustration only and are not intended to limit the scope of the invention disclosed herein.

Examples 1 to 4

The following examples 1 to 12 of Tables 1 to 6 illustrate the superior lead corrosion inhibition of the compounds of the present disclosure. Each formulation of Examples 1 to 12 were tested in the Ethyl Oxidation Test, a bubbling oxidation test run for 120 hours on 300 grams of oil in an ASTM D943 apparatus at 300° F., with 5 l/hr oxygen bubbling through the oil, and one inch square lead coupons. As the test proceeds, the oxidized oil becomes very corrosive to the lead coupon. The lead content of the oxidized oils was done by the ICP method.

The formulations in the examples 1 to 12 below consisted of a "core" group of medium speed diesel additive components including antiwear/EP agents, alkalinity agents, detergents and antioxidants. The formulations were at a TBN of about 17 and had sulfated ash levels of about 1.8 wt. % based on the total weight of the composition.

In Examples 2 to 4, a polybutenyl bis-3-amino-1,2,4-triazole ("BAT") of the present disclosure (a reaction product of polyisobutenyl succinic anhydride and aminoguanidine bicarbonate) was added to this "core" formulation in the amounts indicated. The BAT compound was formed using a high reactivity polybutenyl group having a number average molecular weight of about 2100. A second dispersant, which is a 2100 molecular weight succinimide dispersant, was added to Examples 1 to 3 in the amounts indicated in Table 1.

TABLE 1

MSD Formulations

| | EXAMPLE | | | |
|---|---|---|---|---|
| | 1 | 2 | 3 | 4 |
| "Core" MSD Formulation | 6.85% | 6.85% | 6.85% | 6.85% |
| BAT (2100 HR) | 0% | 2% | 4% | 6.00% |
| Second Dispersant | 6% | 4% | 2% | 0% |

During the oxidation test, an air condenser retained most of the volatiles, and the lubricant composition was sampled every 24 hours and analyzed to determine oil lead content. The results are shown in Table 2.

TABLE 2

Results of EOT testing.

| 24 hour time intervals | Ex. 1 (ppmw Lead) | Ex. 2 (ppmw Lead) | Ex. 3 (ppmw Lead) | Ex. 4 (ppmw Lead) |
|---|---|---|---|---|
| 24 hours | 20 | 3 | 4 | 3 |
| 48 hours | 688 | 6 | 3 | 1 |
| 72 hours | 1840 | 30 | 3 | 4 |
| 96 hours | 2350 | 123 | 25 | 16 |
| 120 hours | — | 353 | 103 | 89 |

As shown from the results of Table 2, the Examples 2 to 4 that contained BAT had significantly reduced lead corrosion as compared with the Example 1, which only contained the second dispersant compound without BAT.

Example 5 contained a polybutenyl bis-3-amino-1,2,4-triazole ("BAT") of the present disclosure (a reaction product of polyisobutenyl succinic anhydride and aminoguanidine bicarbonate) which was added to a "core" formulation, as described above, in the amounts indicated in Table 3. The BAT compound was formed using a high reactivity polybutenyl group having a number average molecular weight of about 1300. Examples 6 to 8 show comparison examples of first comparison metal corrosion inhibitor, Irgamet 30 (Examples 6 and 8), which is disclosed in copending application Ser. No. 11/842,729, filed on Aug. 21, 2007 in the name of David Hutchison and entitled LUBRICATING COMPOSITION, the description of which is incorporated by reference herein in its entirety, and a second commercially available comparison metal corrosion inhibitor (Example 7), in the same core additive package used for Example 5, but without the BAT compound.

TABLE 3

MSD Formulations

| | EXAMPLE | | | |
|---|---|---|---|---|
| | 5 | 6 | 7 | 8 |
| "Core" MSD Formulation | 5.03 wt % | 5.03 wt % | 5.03 wt % | 5.03 wt % |
| BAT (1300 HR) | 2 wt % | 0 | 0 | 0 |
| Comparison Metal Inhibitor 1 | 0 | 500 ppmw | 0 | 330 ppmw |
| Comparison Metal Inhibitor 2 | 0 | 0 | 500 ppmw | 0 |

During the oxidation test, an air condenser retained most of the volatiles, and the lubricant composition was sampled for and analyzed every 24 hours to determine oil lead content. The results are shown in Table 4

TABLE 4

| Results of EOT testing. | | | | |
|---|---|---|---|---|
| 24 hour time intervals | Ex. 5 (ppmw Lead) | Ex. 6 (ppmw Lead) | Ex. 7 (ppmw Lead) | Ex. 8 (ppmw Lead) |
| 24 hours | 1 | 0 | 2 | 5 |
| 48 hours | 0 | 42 | 108 | 13 |
| 72 hours | 1 | 269 | 622 | 38 |
| 96 hours | 1 | 1080 | 2860 | 107 |
| 120 hours | 1 | 4960 | 6610 | 286 |

As shown from the results of Table 4, Example 5 containing BAT had significantly reduced lead corrosion as compared with Examples 6 to 8, which contained the comparison metal corrosion inhibitors without BAT.

In Example 9, a polybutenyl bis-3-amino-1,2,4-triazole ("BAT") of the present disclosure (a reaction product of 1000 molecular weight polyisobutenyl succinic anhydride and aminoguanidine bicarbonate) replaced the usual amounts of dispersant and boundary friction modifier in a commercial MSD engine oil employing 7.0 wt % of a commercial additive ("Commercial MSD Additive 1"). Example 10 shows a comparison example of an engine oil containing a first comparison metal corrosion inhibitor, Irgamet 30 ("Comparison Inhibitor 1"), discussed above, in the same Commercial MSD Additive 1 used for Example 9, but without the BAT and containing the usual dispersant and boundary friction modifier. Example 11 is an engine oil containing the Commercial MSD Additive 1 without modification. Example 12 is an engine oil containing a second commercially available medium speed diesel additive formulation.

TABLE 5

| MSD Formulations | | | | |
|---|---|---|---|---|
| | EXAMPLE | | | |
| | 9 | 10 | 11 | 12 |
| "Commercial MSD Additive 1, without the usual amounts of dispersant and boundary friction modifier | 7.0 wt % | — | — | — |
| 1000 Molecular Weight BAT | 5.8 wt % | — | — | — |
| Comparison inhibitor 1 | — | 330 ppmw | — | — |
| Commercial MSD Additive 1 | | 15.05 wt % | 15.05 wt % | |
| Commercial MSD Additive 2 | — | — | — | 15.74 wt % |

During the oxidation test, an air condenser retained most of the volatiles, and the lubricant composition was sampled for and analyzed every 24 hours to determine oil lead content. The results are shown in Table 6.

TABLE 6

| Results of EOT testing. | | | | |
|---|---|---|---|---|
| 24 hour time intervals | Ex. 9 (ppmw Lead) | Ex. 10 (ppmw Lead) | Ex. 11 (ppmw Lead) | Ex. 12 (ppmw Lead) |
| 24 hours | 0 | 2 | 4 | 28 |
| 48 hours | 0 | 5 | 9 | 34 |
| 72 hours | 2 | 21 | 111 | 92 |
| 96 hours | 9 | 89 | 446 | 495 |
| 120 hours | 24 | 280 | 953 | 1766 |

As shown from the results of Table 6, Example 9 containing BAT had significantly reduced lead corrosion as compared with Examples 10 to 12, which did not contain BAT.

Example 13

1300 molecular weight polybutenyl succinic anhydride was heated to 95° C. An oil slurry of AGBC was added over a 45 minute period. The mixture was heated under vacuum to 160° C. and held at that temperature for about 6 hours, removing water and carbon dioxide. The resulting mixture was filtered.

Bench test results show significant improvement in lead protection in high temperature oxidation test at levels as low as 2% by weight of the Example 13 reaction product when combined with 4% by weight, relative to the total weight of the composition, of a polyisobutenyl succinimide dispersant, HiTEC 646. Oxidation and corrosion testing in the 300° F. Afton EOT test showed superior lead protection and antioxidant performance relative to a commercial triazole.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A lubricant composition comprising:

a major amount of a base oil; and a lead corrosion inhibiting amount of a reaction product of a hydrocarbyl carbonyl compound and an amine compound chosen from guanidines, ureas and thioureas;

with the proviso that the lubricant is essentially free of zinc dialkyldithiophosphate wear inhibitors, and substantially free of chlorinated paraffins and calcium mannich phenate, and wherein the mole ratio of hydrocarbyl carbonyl to amine compound is from about 1:1.5 to about 1:2.5.

2. The lubricant composition of claim 1, wherein the composition is substantially free of chlorine containing compounds.

3. The lubricant composition of claim 1, wherein the composition comprises a sulfur concentrate of about 4000 ppmw or less and a sulfated ash concentration of about 1.0% wt or less, based on the total weight of the composition.

4. The lubricant composition of claim 1, wherein the hydrocarbyl carbonyl compound is chosen from hydrocarbyl substituted succinic anhydrides, hydrocarbyl substituted succinic acids, and esters of hydrocarbyl substituted succinic acids.

5. The lubricant composition of claim 1, wherein the hydrocarbyl carbonyl compound is chosen from compounds of formula IV:

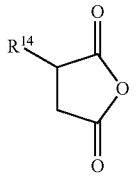

wherein $R^{14}$ is a hydrocarbyl moiety.

6. The lubricant composition of claim 5, wherein $R^{14}$ is a polyolefin radical having a number average molecular weight of from about 100 to about 10,000 daltons.

7. The lubricant composition of claim 6, wherein the polyolefin radical is a polyisobutylene radical.

8. The lubricant composition of claim 7, wherein the polyisobutylene radical is derived from high reactivity polyisobutenes having at least 60% or more terminal olefinic double bonds.

9. The lubricant composition of claim 6, wherein $R^{14}$ is derived from an alpha olefin made by the oligomerization of ethylene.

10. The lubricant composition of claim 1, wherein the amine is a compound of the general formulae II, or salts thereof:

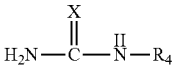

where X is $NR^5$, O or S, wherein $R^5$ is H or $C_1$ to $C_{15}$ hydrocarbyl; and $R^4$ is H, —$NR^7R^8$ or $C_1$ to $C_{20}$ hydrocarbyl or hydroxyl-substituted hydrocarbyl, wherein $R^7$ and $R^8$ can be the same or different and are H or $C_1$ to $C_{20}$ hydrocarbyl or hydroxyl-substituted hydrocarbyl.

11. The lubricant composition of claim 1, wherein the amine is chosen from the inorganic salts of guanidines.

12. The lubricant composition of claim 1, wherein the amine is a salt of aminoguanidine.

13. The lubricant composition of claim 1, wherein the amine is aminoguanidine bicarbonate.

14. A method of improving lead corrosion protection of a machine, the method comprising:

contacting a lead part in a machine with a lubricant composition comprising a minor amount of a reaction product of a hydrocarbyl carbonyl compound and an amine compound chosen from guanidines, ureas and thioureas;

wherein the lubricant composition provides improved lead corrosion protection as compared to the same composition that does not contain the reaction product, where both compositions are employed under the same machine operating conditions over the same period of time, and wherein the mole ratio of hydrocarbyl carbonyl to amine compound is from about 1:1.5 to about 1:2.5.

15. The method of claim 14, wherein the lubricant composition is substantially free of chlorinated paraffins and calcium mannich phenate.

16. The method of claim 14, wherein the hydrocarbyl carbonyl compound is chosen from compounds of formula IV:

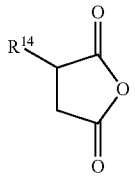

wherein $R^{14}$ is a hydrocarbyl moiety.

17. The method of claim 16, wherein $R^{14}$ is a polyolefin radical having a number average molecular weight of from about 100 to about 10,000 daltons.

18. The method of claim 17, wherein the polyolefin radical is polyisobutylene.

19. The method of claim 17, wherein $R^{14}$ is derived from an alpha olefin made by the oligomerization of ethylene.

20. The method of claim 14, wherein the amine is a compound of the general formulae II, or salts thereof:

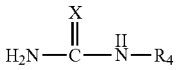

where X is $NR^5$, O or S, wherein $R^5$ is H or $C_1$ to $C_{15}$ hydrocarbyl; and $R^4$ is H, —$NR^7R^8$ or $C_1$ to $C_{20}$ hydrocarbyl or hydroxyl-substituted hydrocarbyl, wherein $R^7$ and $R^8$ can be the same or different and are H or $C_1$ to $C_{20}$ hydrocarbyl or hydroxyl-substituted hydrocarbyl.

21. The method of claim 14, wherein the amine is aminoguanidine bicarbonate.

22. The method of claim 14, wherein the machine is selected from the group consisting of spark ignition and compression-ignition internal combustion engines.

23. The method of claim 14, wherein the engine is selected from the group consisting of diesel engines, marine engines, rotary engines, turbine engines, locomotive engines, propulsion engines, aviation piston engines, stationary power generation engines, continuous power generation engines, engines comprising silver parts, and engines comprising lead parts.

24. The method of claim 14, wherein the machine is a medium speed diesel engine.

* * * * *